US006320538B1

(12) United States Patent
Lalezari et al.

(10) Patent No.: US 6,320,538 B1
(45) Date of Patent: Nov. 20, 2001

(54) METHOD AND APPARATUS FOR CALIBRATING AN ELECTRONICALLY SCANNED REFLECTOR

(75) Inventors: Farzin Lalezari, Boulder; P. Keith Kelly, Lakewood, both of CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/545,226

(22) Filed: Apr. 7, 2000

(51) Int. Cl.[7] ..... H01Q 3/22
(52) U.S. Cl. ..... 342/371; 342/368
(58) Field of Search ..... 342/368, 371, 342/174, 5

(56) References Cited

U.S. PATENT DOCUMENTS

| | | | |
|---|---|---|---|
| 3,164,835 | 1/1965 | Alsberg | 343/779 |
| 3,453,633 | 7/1969 | Phillips | 343/779 |
| 3,490,021 | 1/1970 | Hogg et al. | 343/100 |
| 4,203,105 | 5/1980 | Dragone et al. | 343/781 |
| 4,578,680 | 3/1986 | Haupt | 343/703 |
| 4,586,051 | 4/1986 | Saitto et al. | 343/703 |
| 4,638,322 * | 1/1987 | Lamberty | 343/761 |
| 4,743,914 | 5/1988 | Schuss et al. | 343/754 |
| 5,003,134 | 3/1991 | Berkowitz et al. | 342/372 |
| 5,200,758 | 4/1993 | Gillard | 343/880 |
| 5,353,031 | 10/1994 | Rathi | 342/372 |
| 5,414,431 | 5/1995 | McCoskey | 342/352 |
| 5,576,721 | 11/1996 | Hwang et al. | 343/753 |
| 5,841,392 | 11/1998 | Kishimoto | 342/125 |

* cited by examiner

*Primary Examiner*—Dao Phan
(74) *Attorney, Agent, or Firm*—Sheridan Ross P.C.

(57) ABSTRACT

A method an apparatus for calibrating an electronically scanned reflector (ESR) antenna to compensate for mechanical distortions in a reflector and feed thereof first determines displacement values for a multitude of points on the reflector and the feed. The displacement values are then analyzed to determine the types of distortion, if any, that are present within the ESR antenna system. Compensation values are then determined for each of a plurality of beam positions based on the type(s) of distortion identified. The compensation values are stored in a lookup table for later use in generating antenna beams in the corresponding beam position.

30 Claims, 11 Drawing Sheets

(Top View)

(Top View)

(Top View)

(Top View)

(Top View)

(Side View)

(Side View)

(Top View)

(Top View)

60

| | BEAM POSITION | ROW | PHASE COMPENSATION VALUES | AMPLITUDE COMPENSATION VALUES |
|---|---|---|---|---|
| ELEMENTS IN ROW | | | 1 2 3 4 5 6 7 8 9 ... 21 | 1 2 3 4 5 6 7 8 9 ... 21 |
| | 1 | 1 | $\phi_1$ $\phi_2$ $\phi_3$ $\phi_4$ $\phi_5$ $\phi_6$ $\phi_7$ $\phi_8$ $\phi_9$ ... $\phi_{21}$ | $A_1$ $A_2$ $A_3$ $A_4$ $A_5$ $A_6$ $A_7$ $A_8$ $A_9$ ... $A_{21}$ |
| | 2 | 1 | . | . |
| | 3 | 1 | . | . |
| | 4 | 1 | . | . |
| | 5 | 1 | . | . |
| | 6 | 1 | . | . |
| | . | . | . | . |
| | . | . | . | . |
| | . | . | . | . |
| | N x # of Rows | . | . | . |

FIG. 15

METHOD AND APPARATUS FOR CALIBRATING AN ELECTRONICALLY SCANNED REFLECTOR

FIELD OF THE INVENTION

The invention relates generally to antenna systems and, more specifically, to antenna systems that use phased array techniques.

BACKGROUND OF THE INVENTION

An electronically scanned reflector (ESR) is an antenna that uses a phased array feed to illuminate a nearby reflector unit to generate one or more steerable antenna beams. Such antennas are being used increasingly in space-based applications such as, for example, satellite communications applications. As can be appreciated, antennas implemented in such remote, unmanned space applications can be difficult to calibrate. That is, should the antenna undergo mechanical distortions in space that negatively effect its ability to generate desired antenna beams, it is often difficult to compensate for these distortions after they have occurred because the antenna is so far away. In the past, calibration of space-based phased array antennas was generally performed during lengthy procedures involving a multitude of ground station measurements that were complicated by orbit velocities, signal to noise, and antenna location uncertainties. Such procedures are very complex and expensive to implement and the results are sometimes inaccurate.

Therefore, there is a need for a method and apparatus for calibrating an electronically scanned reflector antenna that can be used in space based antenna applications. The method and apparatus should be capable of compensating for mechanical distortions to a space based antenna to a relatively high degree of accuracy without requiring remote antenna pattern measurements. In addition, the method and apparatus should be relatively easy to implement and operate.

SUMMARY OF THE INVENTION

The present invention relates to a method and apparatus for calibrating an electronically scanned reflector (ESR) antenna system. The method and apparatus are ideal for use with ESRs that are stationed in remote, unmanned locations, such as those implemented in space-based applications. The method and apparatus can also be used in connection with ESRs in any other environment. Displacement values are first generated for a plurality of points on the reflector and feed of the ESR antenna that describe how far the points are from their designed locations. The displacement values are then used to characterize the type of distortion within the reflector and the type of distortion within the feed. Based on the type of distortion found, compensation values are generated for each of the elements within the feed array for each beam position of the antenna. The compensation values are then used to assemble a lookup table for the antenna that can be used during normal antenna operation to achieve the desired beam positions of the antenna system.

BRIEF DESCRIPTION OF THE DRAWINGS

FIG. 15 illustrates a lookup table that is generated in accordance with one embodiment of the present invention.

DETAILED DESCRIPTION

Figure 1:
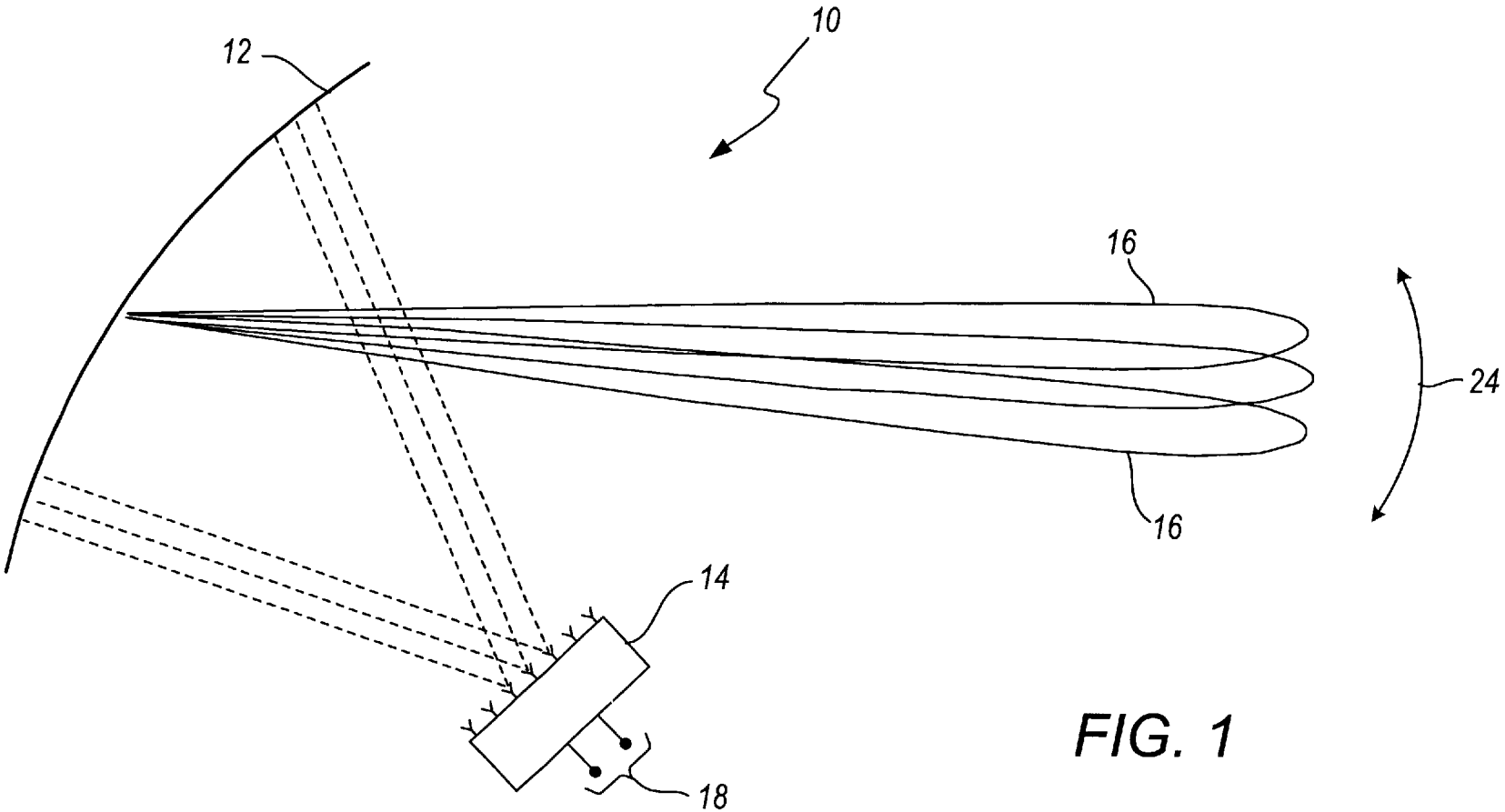
FIG. 1 is a side view of an ESR antenna system that can be calibrated in accordance with the present invention.

FIG. 1 is a side view of an electronically scanned reflector (ESR) antenna system 10 that can be calibrated in accordance with the present invention. As illustrated, the ESR antenna system 10 includes a cylindrical, parabolic reflector 12 that is fed by a feed array 14 to generate an antenna beam 16 that can be steered in both azimuth and elevation. The cylindrical, parabolic reflector 12 includes a conductive reflector surface that has a parabolic curve in one dimension (the dimension shown in FIG. 1) and is straight in another dimension (the dimension into the page of FIG. 1). The feed array 14 includes a two-dimensional array of antenna elements that are located at or near the focal point of the reflector 12. A more detailed description of such an antenna system can be found in United States Patent Application No. 09/266,704 filed Mar. 11, 1999 now U.S. Pat. No. 6,043,789 issued Mar. 28, 2000, which is co-owned with the present application and is hereby incorporated by reference.

During a transmit operation, the feed array 14 receives a transmit signal at an input/output port 18 which it space feeds to the reflector 12 (in a primary transmit beam) using a subset of the antenna elements in the array. The reflector 12 then reflects the transmit signal to generate a secondary transmit beam 16 that can be received by a remote entity. Because the reflector 12 is parabolic in one dimension, it performs a beam collimating function in this dimension. During a receive operation, the reflector 12 receives a signal from a remote location and focuses the received signal on a subset of the elements in the feed array 14. The subset of elements that the received signal is focused on depends upon the direction from which the signal is received. If the elements in the subset are configured to receive signals from that direction (i.e., there is an active receive beam in that direction), the antenna elements will pass the signal to receiver circuitry via port 18 for further processing. For purposes of convenience, the invention will be described in connection with the generation of transmit beams by the antenna system 10. It should be understood, however, that the inventive principles and techniques are equally applicable to the generation of receive beams by the antenna system 10.

Figure 2:
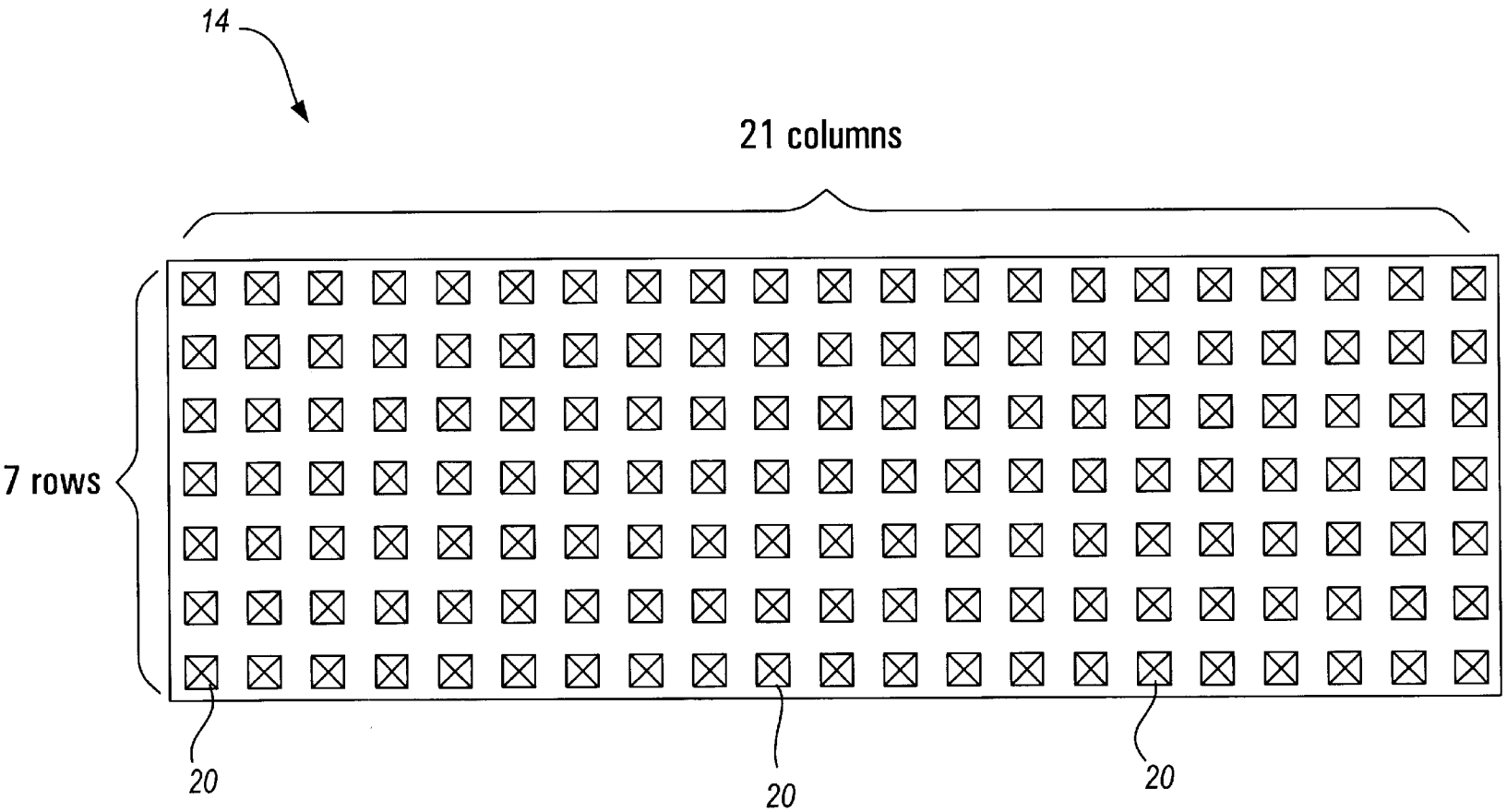
FIG. 2 is a front view of a feed array that can be utilized by the ESR antenna system illustrated in FIG. 1.

FIG. 2 is a front view of the face of a feed array 14 that can be used in the ESR antenna system 10 of FIG. 1. As illustrated, the feed array 14 includes a plurality of antenna elements 20 arranged in a two-dimensional array of rows and columns. In the illustrated embodiment, for example, there are 7 rows and 21 columns of elements 20. The number of rows and columns in any particular implementation will generally depend upon the application being performed. In one embodiment of the invention, steering in the elevation plane (e.g., see arrow 24 in FIG. 1) is accomplished by switching between rows within the feed array 14. That is, each row of 21 elements in the feed array 14 is independently energizable for generating a corresponding antenna beam 16. Thus, by energizing the individual rows in sequence, a section of space is scanned in elevation. Preferably, the antenna beams 16 will overlap so that there is little crossover loss between adjacent beams in elevation.

Instead of utilizing a single row of elements to generate each beam, row groups having multiple rows can alternatively be used. For example, the first and second row (i.e., a first row group) within the feed array 14 of FIG. 2 can be used to generate one beam, the second and third row (i.e., a second row group) can be used to generate another beam, the third and fourth row (i.e., a third row group) can be used to generate another beam, and so on. The number of rows within a row group will generally depend upon the application being implemented.

The antenna beam 16 generated by a particular row (or row group) is steered in the azimuth plane using conventional phased array techniques. That is, a constant excitation phase increment is generated between adjacent elements within the row to point the resulting beam in a desired azimuthal direction. By changing the excitation phase increment between elements with time, the resulting beam 16 will scan a section of space in azimuth. In general, the beam 16 generated by a particular row (or row group) will have N individual azimuthal positions, where N is an integer value. Thus, the ESR antenna system 10 will be capable of generating beams in M different beam positions, where M is the product of N and the number of rows (or row groups) in the feed array 14.

Figure 3:
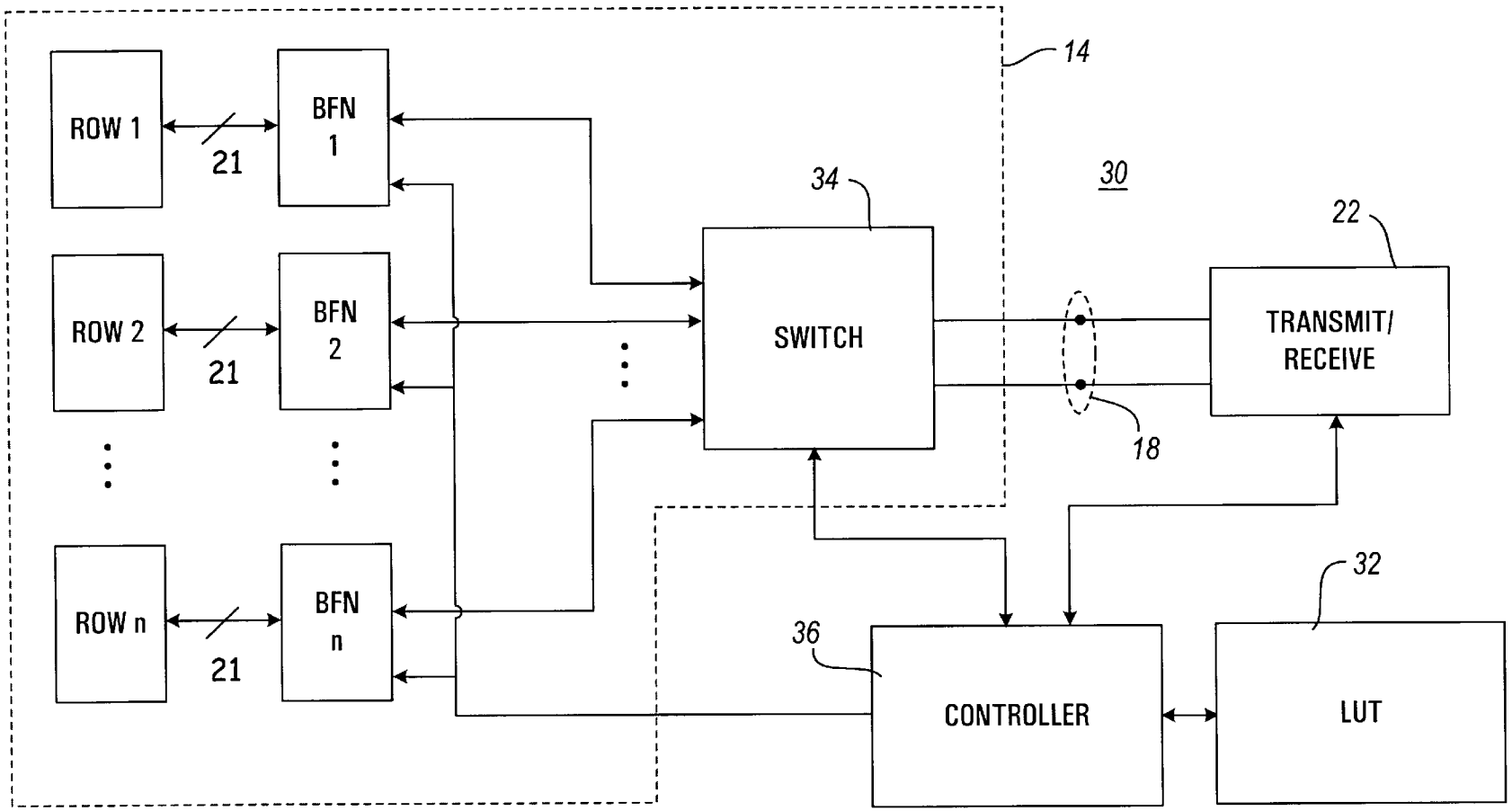
FIG. 3 is a block diagram illustrating a control system for use in generating predetermined antenna beams in the ESR antenna system of FIG. 1 in accordance with one embodiment of the present invention.

FIG. 3 is a block diagram illustrating a control system 30 for use in generating predetermined antenna beams in the ESR antenna system 10 of FIG. 1 in accordance with one embodiment of the present invention. As illustrated, the control system 30 includes: feed array 14, a controller 36, a lookup table (LUT) 32, and a transmit/receive unit 22. The feed array 14 includes: a plurality of antenna element rows (Row 1, Row 2, . . . , Row n), a plurality of beamformer networks (BFN 1, BFN 2, . . . , BFN n), and a switch 34. The controller 36 is coupled to the feed array 14 for use in configuring the feed array 14 to generate antenna beams in predetermined beam positions. The LUT 32 includes a set of beamformer parameter values for each of the possible beam positions of the ESR antenna system 10. When the controller 36 determines that a beam needs to be generated in a particular beam position, it retrieves the beamformer parameter value set for that beam position (e.g., phase shifter values, amplitude values, etc.) from the LUT 32 and delivers the parameter values to an appropriate beamformer network for that beam position. The information retrieved from the LUT 32 can also indicate which beamformer network (BFN 1, BFN 2, . . . , BFN n) is to receive the beamformer parameter values for the desired beam position. Once the appropriate beamformer network has been configured, the controller 36 instructs the switch 34 to direct the transmit signal subsequently received at port 18 to that beamformer network. The controller 36 then instructs the transmit/receive unit 22 to generate the required transmit signal and to deliver it to the switch 34. The transmit signal is subsequently transmitted by the ESR antenna system 10 within a transmit beam in the desired beam position. A similar procedure is followed to generate a receive beam in a desired beam position.

Each of the beamformer networks (BFN 1, BFN 2, . . . , BFN n) is coupled to one of the antenna element rows (Row 1, Row 2, . . . , Row n) for use in generating desired antenna beams using that row of elements. Thus, each of the beamformer networks (BFN 1, BFN 2, . . . , BFN n) will include a phase shifter for each of the elements in the corresponding row for varying an excitation phase associated with that element. Each of the beamformer networks (BFN 1, BFN 2, . . . , BFN n) can also include an amplitude adjustment device (e.g., a variable attenuator or a variable gain amplifier) for each of the antenna elements within the corresponding row for varying an excitation amplitude associated with the element.

Figure 4:
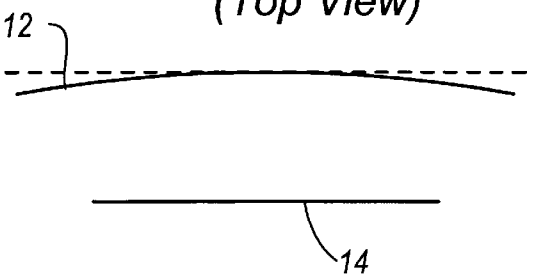
FIGS. 4–8 are top views illustrating various distortion types that can occur within an ESR antenna system.
Figure 5:
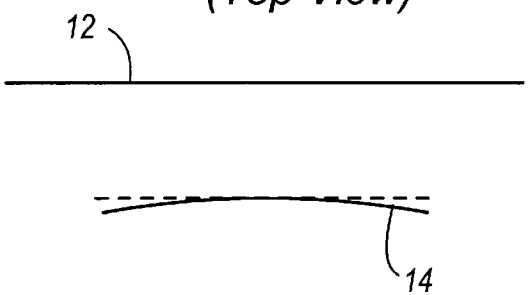
Figure 6:
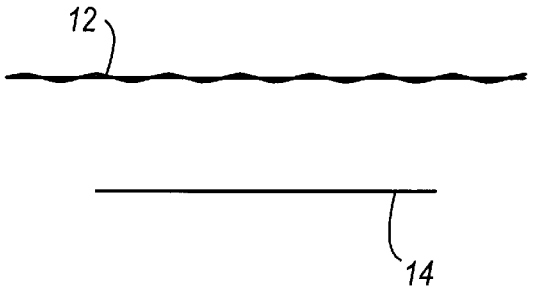
Figure 7:
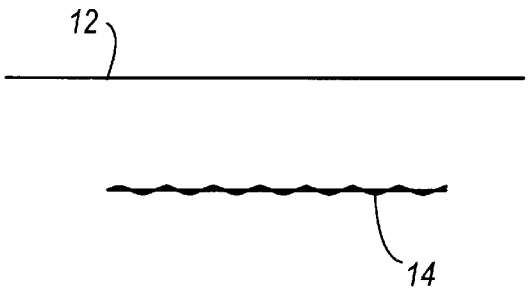
Figure 8:
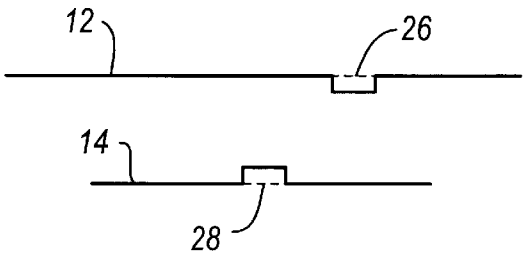

As described above, both the reflector 12 and the feed array 14 are subject to mechanical distortions that can change both the direction and shape of the antenna beams generated by the ESR antenna system 10. These distortions can be caused by any of a number of different mechanisms (e.g., physical impacts, temperature changes, manufacturing defects, etc.) and can take any of a number of different forms. FIGS. 4–8 are simplified top views of an ESR antenna system illustrating various distortion types that can occur. FIG. 4, for example, illustrates a distortion type known as reflector curvature that is characterized by the reflector 12 developing a curved shape (either inward or outward) along its length instead of the desired straight shape. FIG. 5 illustrates a similar distortion type known as feed curvature that is characterized by the feed array 14 developing a curved shape (either inward or outward). FIG. 6 illustrates a distortion type known as reflector ripple where the reflector 12 develops a periodic ripple shape along its length. FIG. 7 illustrates a similar distortion type known as feed ripple. FIG. 8 illustrates distortion types known as reflector offset and feed offset where the reflector 12 and the feed 14, respectively, maintain their desired shapes but are translated either inward or outward from their proper positions 26, 28.

The ESR antenna system 10 can include any combination of the above distortion types as part of an overall mechanical distortion scenario. In addition, the reflector 12 and/or the feed array 14 can include one or more of these distortion types over only a portion of its total surface area. For example, reflector 12 may display reflector curvature at one end and reflector ripple at another end. Alternatively, the reflector 12 can display both reflector curvature and reflector ripple over the entire surface thereof.

Figure 10:
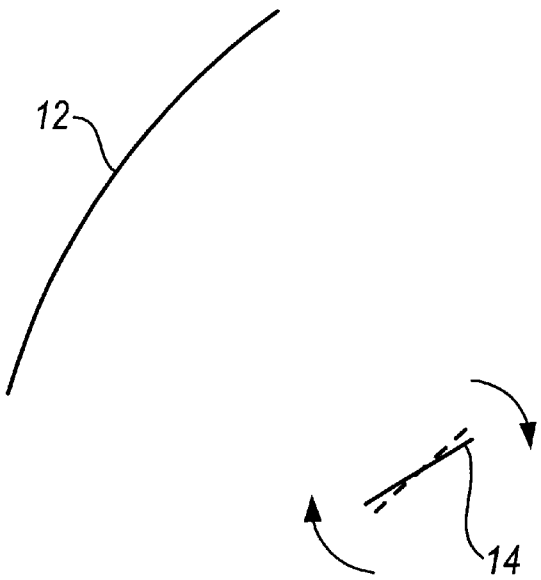
FIGS. 9–10 are side views illustrating additional distortion types that can occur within an ESR antenna system.
Figure 9:
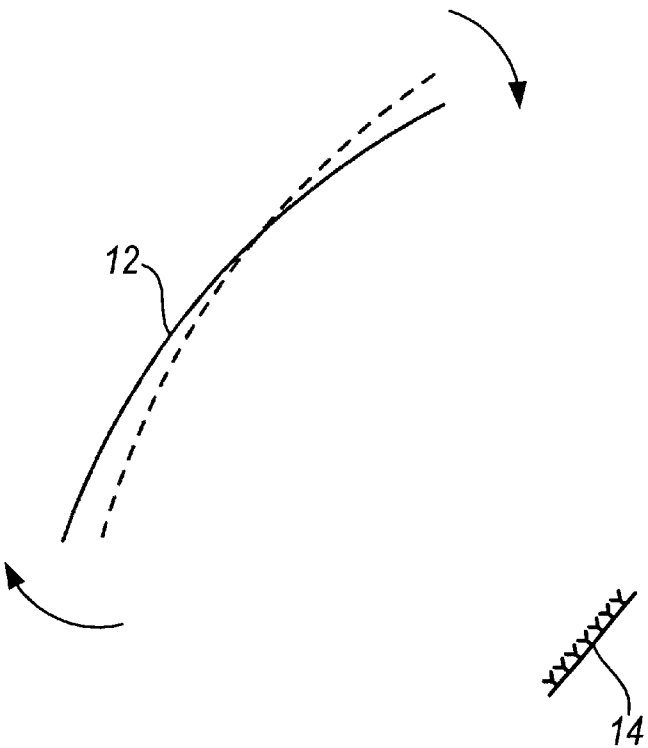

FIGS. 9 and 10 are simplified side views illustrating other possible mechanical distortions within the ESR antenna system 10. FIG. 9 illustrates a distortion type known as reflector twist where the reflector 12 maintains its original shape but is rotated about a pivot point by a particular amount. FIG. 10 illustrates a related distortion type known as feed tilt where the feed array 14 is similarly rotated about a pivot point. In either type of distortion, the rotation can be in either direction (i.e., clockwise or counterclockwise). As before, these distortion types may be present in the antenna system in addition to one or more of the previously described distortion types. Other distortion types are also possible.

In accordance with the present invention, a method and apparatus is provided for calibrating an ESR antenna to compensate for mechanical distortions such as those described above. In a preferred approach, a lookup table is generated having a set of compensation values for each of the possible beam positions that can be generated by the ESR antenna system 10. These compensation values are then used in conjunction with the beamformer parameter values stored in another lookup table (e.g., LUT 32 of FIG. 3) to generate antenna beams in the predetermined beam positions.

Before compensation values are generated, the ESR antenna system 10 first determines how far the reflector 12 and the feed array 14 are from their designed shapes/positions. This can be done using any one of a plurality of known methods. For example, methods using radio frequency (RF) phase measurement, optical path length measurement, optical angle measurements, or temperature tracking can be used. In one RF phase measurement approach, a number of target scatterers are placed at known positions on the surface of the reflector 12 and a family of RF probes are placed at known positions on the face of the feed array 14. The phase response of the system 10 is then measured for various feed excitations using the reflector targets and the feed probes. The resulting phase measurement values are then used to calculate displacement values for a large number of points on both the reflector 12 and the feed array 14. The displacement values for a particular point on the reflector 12 or the feed array 14 indicate how far that point is from its designed position (e.g., giving positional errors in each of three orthogonal directions). A similar target/sensor approach can be used to generate displacement values for the reflector 12 and the feed array 14 optically (e.g., using lasers and photosensitive receptors).

If the reflector and/or feed surface distortion can be directly correlated to temperature changes, a temperature tracking approach can be used. This generally requires that the temperature sensitivity of the reflector 12 and the feed array 14 be characterized on the ground to generate a lookup table of surface distortion versus temperature for discrete points on the surfaces of interest. After the antenna has been placed in service, thermocouples distributed on the face of the reflector 12 and the feed array 14 are used to measure the temperature of the corresponding points. The temperature information garnered by this process is then used to reference the lookup table to determine displacement values for points on the reflector 12 and the feed array 14. Other methods for determining displacement values for the reflector 12 and the feed 14 are also possible.

After displacement values have been generated for the system 10, the values are analyzed to determine whether any mechanical distortion exists and, if so, what type or types of distortion are present. After the distortion has been characterized, compensation values are determined for the feed array 14 to compensate for the distortion based on distortion type. If multiple distortion types are present, individual compensation values are determined for each type of distortion. The compensation values for the different distortion types are then combined using superposition techniques to generate composite compensation values for the antenna system 10. In a preferred embodiment, an individual set of compensation values is generated for each possible beam position of the ESR antenna system 10.

Figure 11:
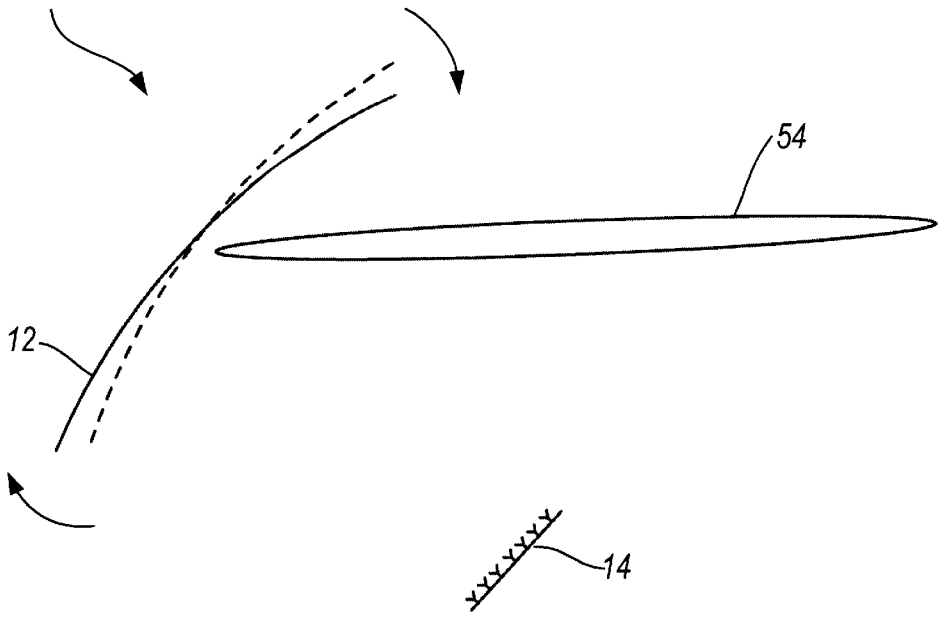
FIGS. 11–12 are side views illustrating techniques that can be implemented to compensate for reflector twist and feed tilt distortion types when generating a predetermined beam position in accordance with one embodiment of the present invention.

FIG. 11 is a side view of an ESR antenna system 50 that has experienced reflector twist distortion. Thus, the beamformer parameter values that would normally be used within the feed array 14 to generate a beam in a desired beam position 54 will now generate a beam in a direction that is shifted in elevation angle from beam position 54. After the antenna system 50 has determined that reflector twist exists, it analyzes each possible beam position of the system 50 to determine optimal antenna settings to achieve each beam position in light of the reflector twist (as characterized by the measured displacement values). As part of the analysis, the system 50 can determine that a different row (or row group) of the feed array 14 would be better to generate a particular beam position (e.g., beam position 54) than the row (or row group) originally designated to generate that beam position. Alternatively, or in addition, the system 50 can determine that excitation amplitude weighting (or similar technique) is to be used to tilt the beam to achieve the desired beam position. Methods for calculating amplitude weighting coefficients to controllably tilt an array antenna beam are well-known in the art. After a decision has been made to use a different row of elements and/or to use amplitude weighting for a particular beam position, the corresponding row information and/or weighting coefficients are stored in a memory unit for later use in generating a beam in that beam position.

Figure 12:
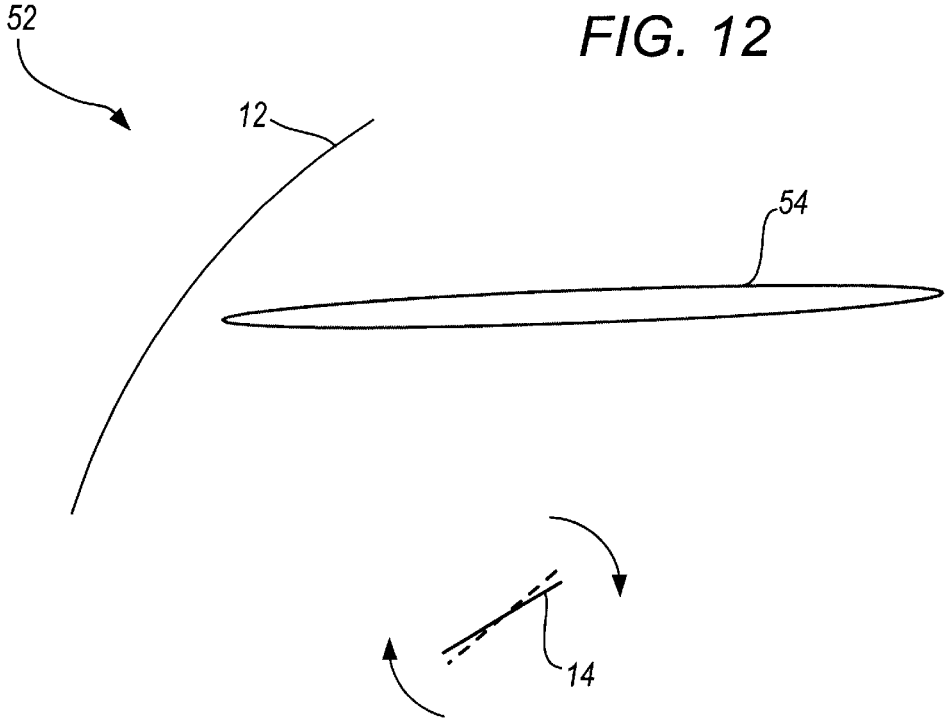

FIG. 12 is a side view of any ESR antenna system 52 that has experienced feed tilt distortion. After the system 52 has determined that feed tilt exists, it follows a procedure similar to that described above with respect to reflector twist. That is, for each possible beam position, the system 52 determines whether it would be better to use a different row of the feed array 14 to generate the beam position in light of the feed tilt. The system 52 will also determine whether amplitude weighting should be used and, if so, will generate the amplitude weighting coefficients needed to achieve the desired beam position. This information is then stored in a memory unit for later use in generating a beam in the corresponding beam position.

Figure 13:
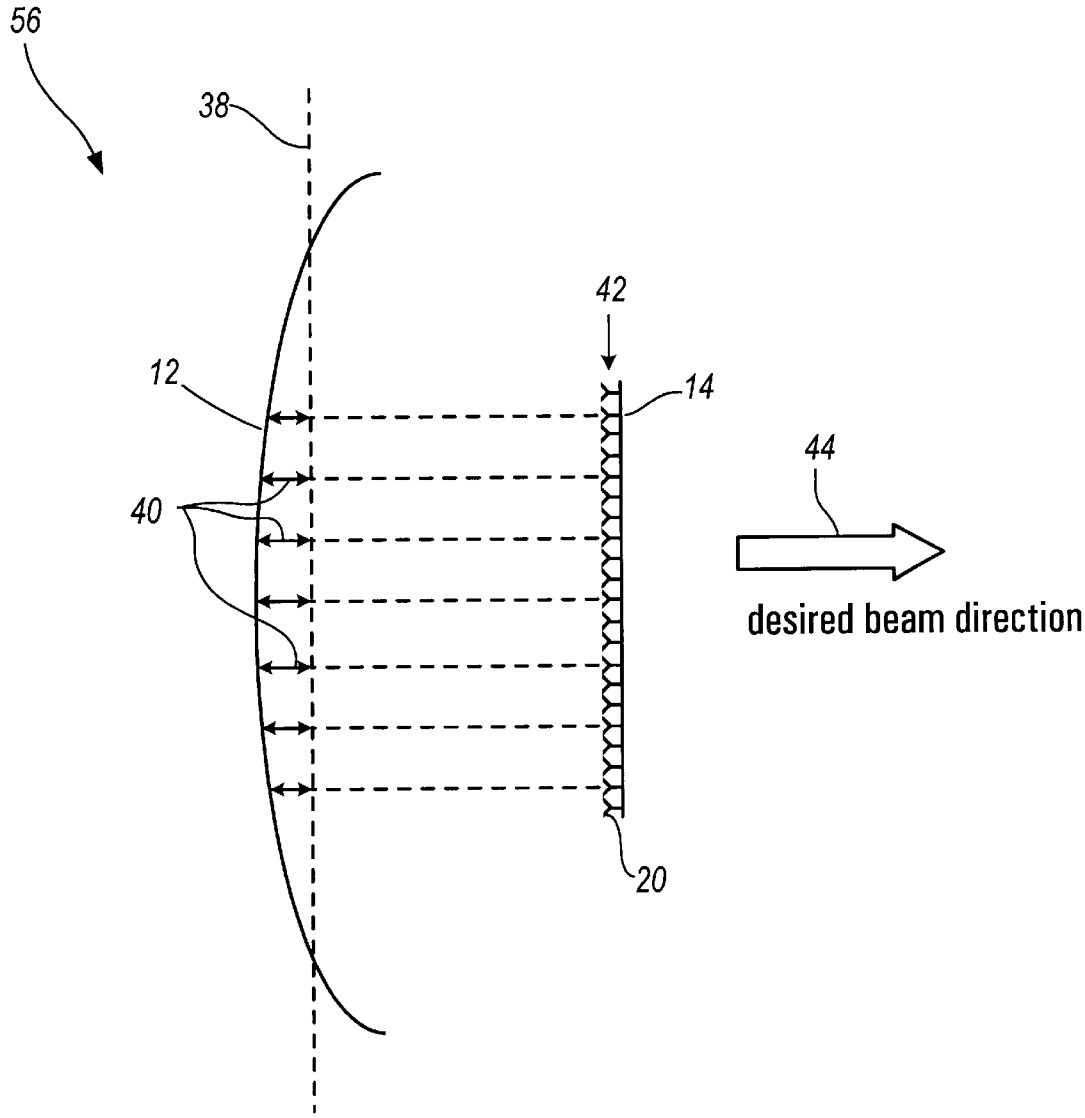
FIGS. 13–14 are top views illustrating methods for determining error values for antenna elements within a row of a feed array for predetermined beam positions of an ESR antenna system in accordance with one embodiment of the present invention.

FIG. 13 is a top view of an ESR antenna system 56 having reflector curvature distortion. As illustrated, the reflector 12 of the system 56 is curved inward at its ends toward the feed array 14 and deviates from the desired reflector shape 38. The curvature of the reflector 12 has been exaggerated in FIG. 13 for illustration purposes. When the system 56 determines that reflector curvature exists, it proceeds to calculate phase compensation values for use in compensating for the curvature. A different set of phase compensation values is generated for each antenna beam position to be generated by the system 56. The phase compensation values are determined through mathematical manipulation of the displacement values previously measured for the reflector 12 and the feed array 14, based on the known direction of each beam position. Thus, signals do not have to be actually transmitted or received from the ESR antenna system 56 to generate the phase compensation values.

To generate phase compensation values for a particular beam position in the antenna system 56, error values 40 must first be determined that describe how far the curved reflector 12 is from its desired position 38 in the area of the reflector surface that will be used by that beam position. For example, FIG. 13 illustrates the determination of error values 40 for a beam position 44 that is directed straight out from the reflector 12 with no azimuthal tilt. An individual error value 40 is determined for each antenna element 20 in the row 42 that is responsible for generating the desired beam position 44. As illustrated, for each element 20 within the row 42, an error value 40 is calculated that measures the distance between the point where the reflector 12 is and the point where the reflector 12 should be (i.e., a point on line 38) along a ray projecting from the corresponding element 20 in the direction of the associated beam position. The error value can be positive or negative depending upon which way the reflector has been distorted (e.g., inward or outward curvature). Because the desired beam 44 in FIG. 13 points straight out, the error values 40 for each of the elements 20 in the row 42 are simply the normal distances between the desired reflector position 38 and the curved reflector 12 at points on the desired reflector position 38 corresponding to the associated elements within row 42. These error values 40 are easily calculated using the displacement values generated previously. In one embodiment, displacement values already exist for the points on the desired reflector position 38 corresponding to the associated elements within row 42 and, therefore, a simple substitution is performed to generate the error values.

Figure 14:
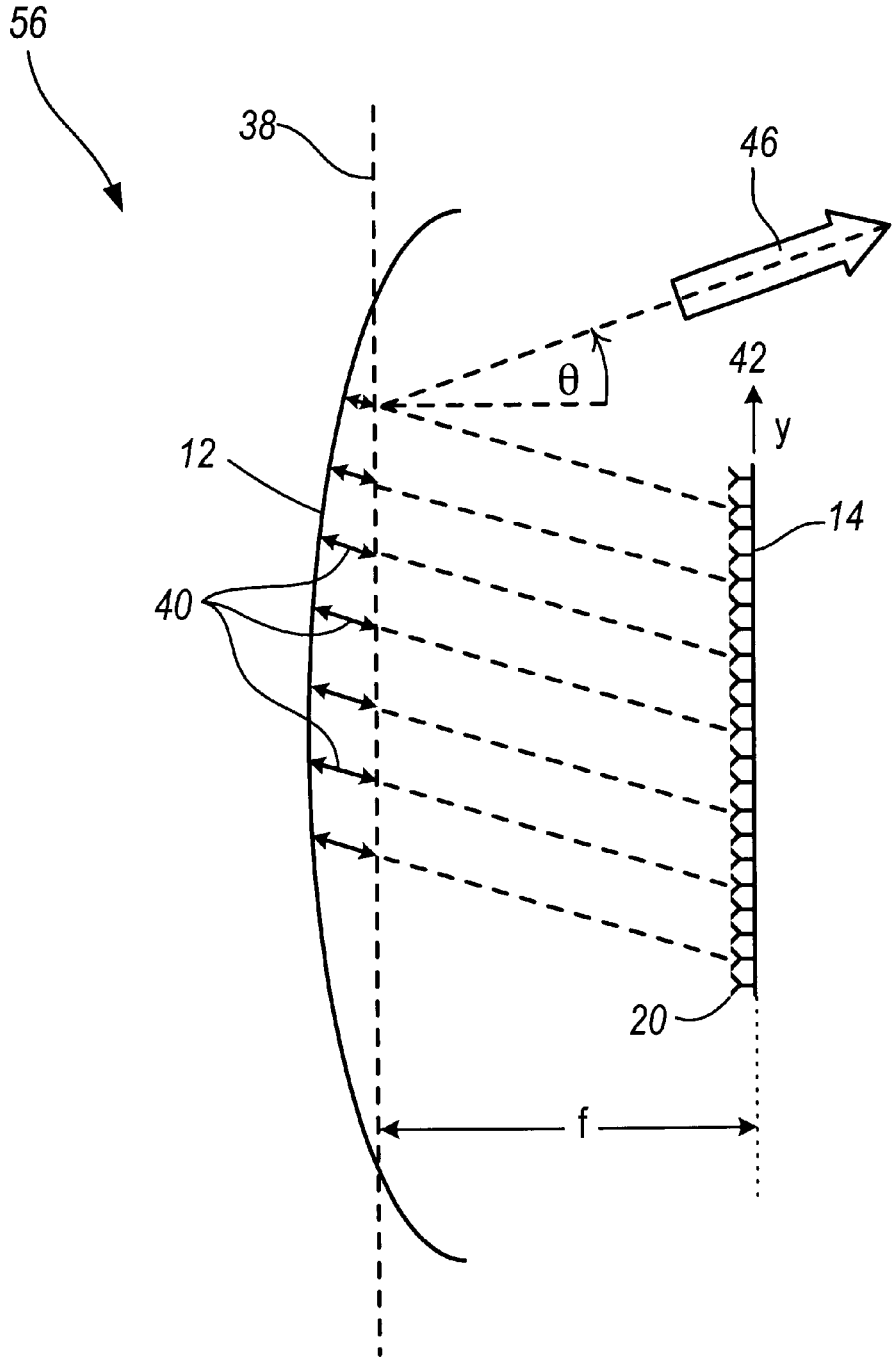

FIG. 14 is a top view of the same ESR antenna system 56 shown in FIG. 13 illustrating the determination of error values 40 for a beam position 46 that is at an acute azimuth angle. As shown, the error values 40 are now generated along slanted rays in the direction of the intended antenna beam position 46. The error values 40 are generated from the previously determined displacement values for the reflector 12 using simple geometric manipulations. This process is used to generate error values 40 for most of the beam positions of the system 56.

After the error values 40 have been determined for a particular beam position, the error values 40 are used to generate the phase compensation values for the beam position. First, each of the error values 40 is converted to a corresponding electrical length value for the frequency of interest. Then, the electrical length value is doubled to generate the phase compensation value for the corresponding antenna element 20. The electrical length value is doubled because any signal (transmit or receive) that is reflected by the reflector 12 will travel through the corresponding error distance twice during the signal propagation. The resulting "phase compensation values" are then stored in association with the corresponding beam position for later use. Thus, in the illustrated embodiment, 21 phase compensation values are stored for each beam position.

If the antenna system 56 of FIG. 13 determines that reflector ripple distortion or reflector offset distortion exists instead of reflector curvature, the system 56 performs substantially the same procedure discussed above in connection with reflector curvature. That is, for each beam position, error values 40 are measured for each of the antenna elements 20 in a corresponding row, the error values are each converted to electrical length value, and the electrical length values are each doubled to generate a phase compensation value for a corresponding element 20. The phase compensation values for each of the elements 20 in the row are then saved in association with the corresponding beam position for later use.

If the antenna system 56 of FIG. 13 determines that feed curvature distortion, feed ripple distortion, or feed offset distortion exists, the system 56 also performs substantially the same procedure set out above for reflector curvature. However, the electrical length values are not doubled to generate the corresponding phase compensation values (i.e., the electrical length values are used as the phase compensation values). This is because the transmit or receive signal will only flow through the error distance once for a feed related distortion (i.e., there is no reflection).

As described previously, multiple different types of distortion can be present within a single ESR antenna system. In such a case, the phase compensation values that are generated for a particular beam position for different distortion types must be combined together to form a single phase compensation value for each antenna element 20. For example, if both reflector curvature and feed curvature are present, the corresponding phase compensation values for a particular element 20 must be combined to generate a single phase compensation value for the element 20. This single phase compensation value is the one that is stored for later use.

FIG. 15 illustrates a lookup table 60 that can be generated in accordance with one embodiment of the present invention. As shown, the lookup table 60 includes an individual entry for each of the beam positions that the corresponding ESR antenna is designed to generate. Each of the entries in the lookup table 60 includes an indication of which antenna element row is to be used to generate the corresponding beam position. Therefore, if a row change has been made due to reflector twist or feed tilt distortion, it will be recorded in the lookup table 60. In one embodiment, the lookup table 60 will only include a row designation if a row change has actually been made.

Each of the entries in the lookup table 60 also includes phase compensation values for each of the antenna elements 20 in the identified row. The lookup table 60 can also include amplitude compensation values for each of the antenna elements 20 within the identified row for use in, for example, tilting a beam in elevation to compensate for reflector twist or feed tilt. The lookup table 60 can also include other compensation information for use in generating antenna beams in predetermined beam positions.

Referring back to FIG. 3, in one embodiment of the invention, the lookup table 60 of FIG. 15 is coupled to the controller 36 of control system 30 for use in generating antenna beams in predetermined beam positions. The lookup table 60 can be made part of LUT 32 or a separate unit can be used. During system operation, the controller 36 will determine that a particular beam position is to be generated. The controller 36 then retrieves the beamformer parameter values for that beam position from the LUT 32 and the compensation values for the beam position from the lookup table 60 of FIG. 15. The controller 36 then uses the compensation values to modify the beamformer parameter values. The controller 36 then delivers the modified values to the appropriate beamformer network for use in generating the desired antenna beam as described previously.

Figure 16:
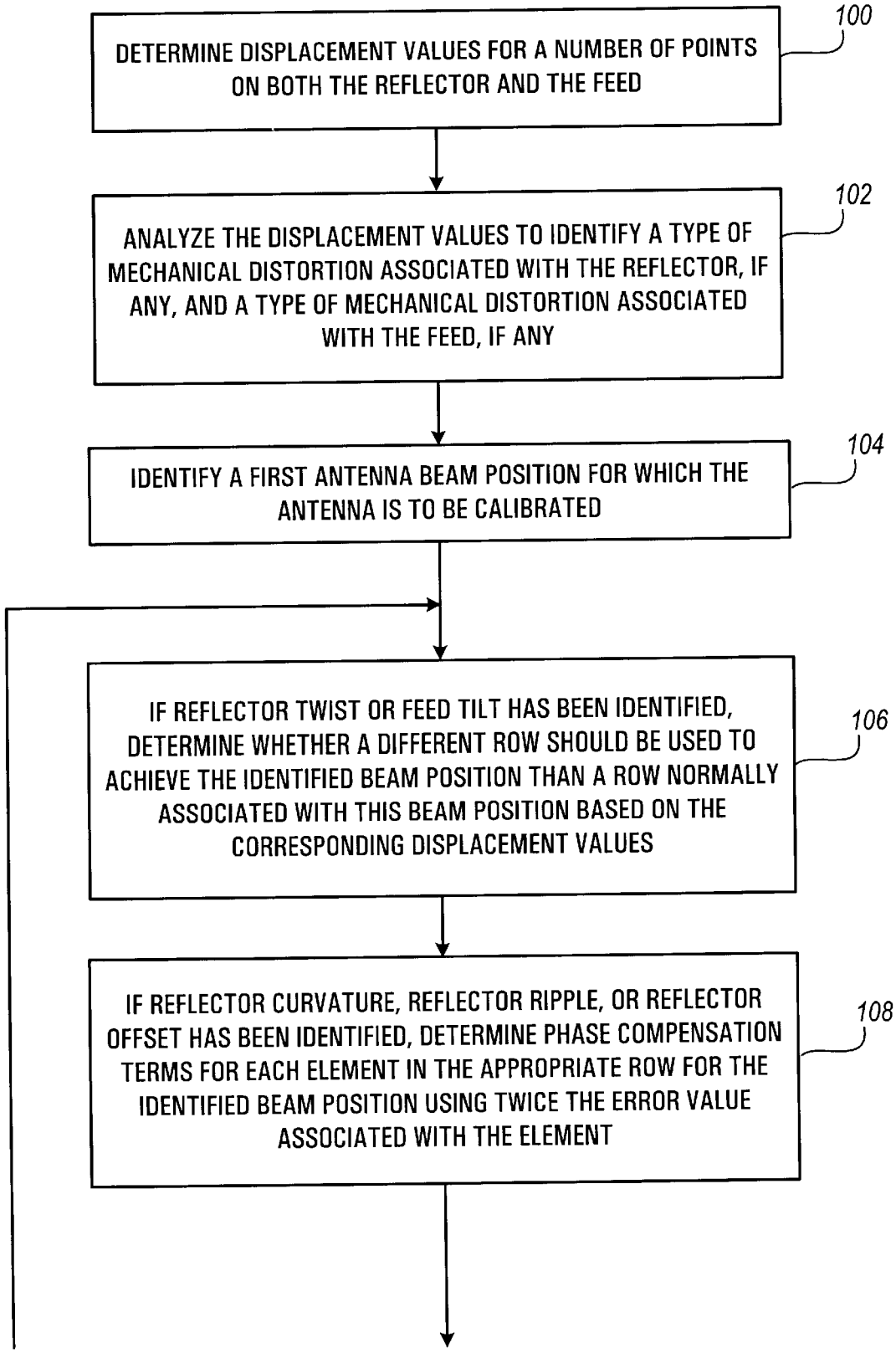
FIGS. 16–17 are portions of a flowchart illustrating a method for calibrating an ESR antenna system in accordance with one embodiment of the present invention.
Figure 17:
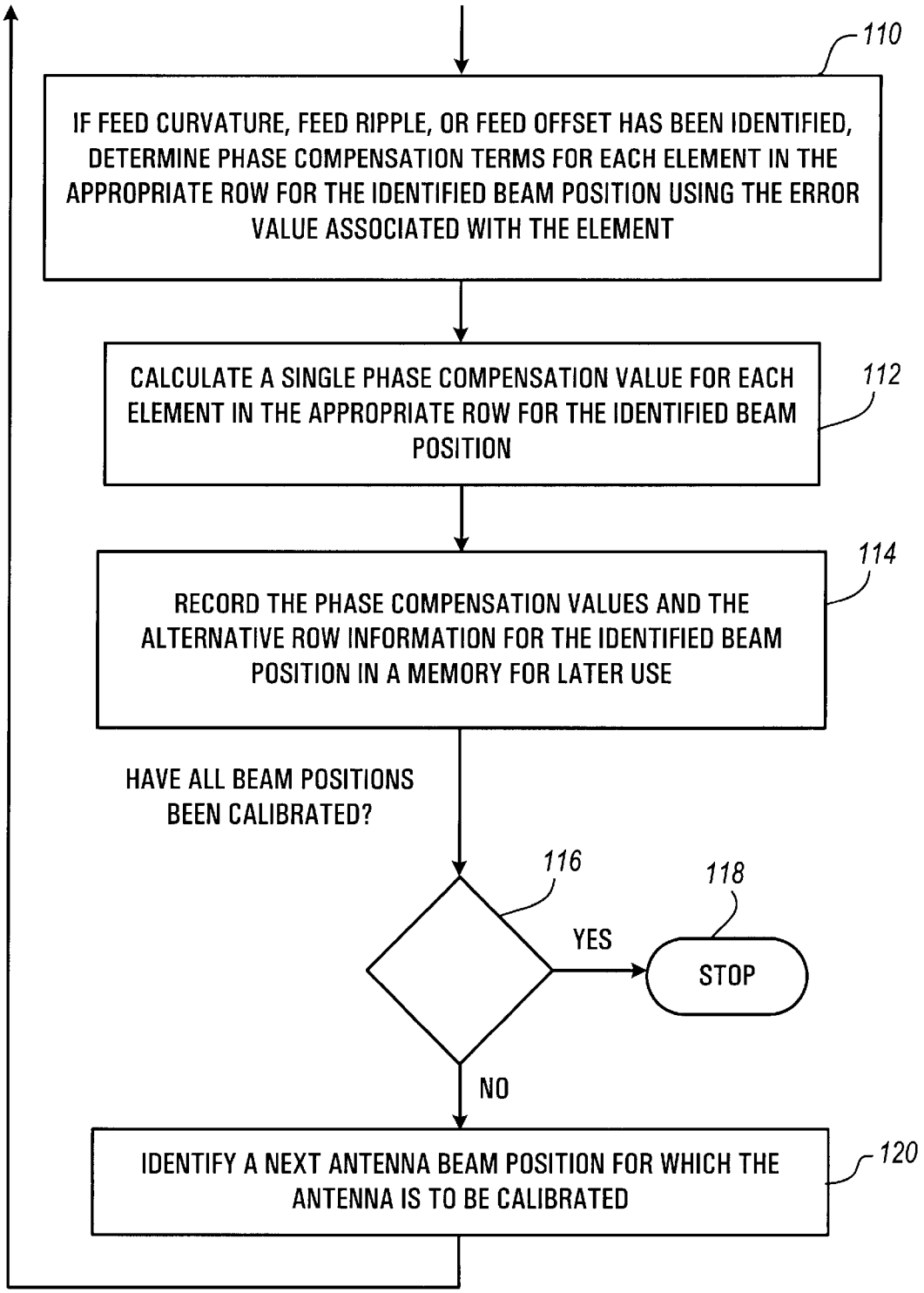

FIGS. 16 and 17 are portions of a flowchart illustrating a method for calibrating an ESR antenna system in one embodiment of the present invention. As shown, displacement values are first generated for a large number of points on both the reflector and the feed of the ESR antenna system indicating how far the points are from desired positions (step 100). The displacement values are then analyzed to identify one or more types of mechanical distortion associated with the reflector and/or the feed, if any such distortion exists (step 102). A first antenna beam position is then identified for calibration (step 104). If it has been determined in step 102 that reflector twist or feet tilts exist within the ESR antenna system, it is next determined whether a different row should be used to achieve the identified beam position than a row that would normally be used to generate that beam position if no distortion were present (step 106). The determination is made by analyzing the displacement values determined in step 100.

If reflector curvature, reflector ripple, and/or reflector offset have been found to exist in step 102, phase compensation terms are next determined for each element in the appropriate row for the identified beam position to compensate for this distortion (step 108). The phase compensation terms are generated by doubling an electrical length associated with a measured error distance for each element. If feed curvature, feed ripple, and/or feed offset have been found to exist in step 102, phase compensation terms are next determined for each element in the appropriate row for the identified beam position to compensate for these distortion types (step 110). Because these distortion types are feed related, the phase compensation term associated with each element is equal to the electrical length calculated from the error distance measured for the element.

If multiple phase compensation terms have been generated for each antenna element in a row for the identified beam position, the values are next consolidated into a single phase compensation value for the element (step 112). The phase compensation values and the alternative row information for the identified beam position are then stored in a memory for subsequent use in generating an antenna beam in the identified beam position (step 114). It is next determined whether all of the beam positions of the ESR antenna system have been calibrated (step 116). If so, the calibration procedure is ended (step 118). If not, a next antenna beam position is identified for calibration (step 120) and the process is repeated. Eventually, compensation values are generated and stored for each beam position of the antenna system.

Using the above procedure, an ESR antenna system can be periodically re-calibrated in the field to account for any changes in the mechanical distortions of the antenna over time. The frequency with which re-calibrations are performed will generally depend upon the types of mechanical distortion that are anticipated in a particular implementation. The re-calibrations can be programmed to occur at predetermined intervals (e.g., during periods of reduced antenna activity) or they can be programmed to occur automatically in response to predetermined stimuli. For example, in space-based applications, the heating and cooling cycles of the antenna will normally be known. It may be decided, therefore, to perform a re-calibration operation after each heating/cooling cycle has occurred. In a terrestrial application, mechanical distortions to the ESR antenna can be caused by, for example, high winds or other environmental conditions. Therefore, re-calibrations can be programmed to occur automatically after such environmental conditions have been detected. Other criteria for performing re-calibrations can also be specified.

Although the present invention has been described in conjunction with its preferred embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. A method for calibrating an electronically scanned reflector (ESR) antenna including a reflector and a phased array feed having a plurality of antenna elements, comprising the steps of:

measuring a mechanical displacement associated with a plurality of points on the reflector and a plurality of points on the phased array feed, said measuring step resulting in a plurality of displacement values;

analyzing said plurality of displacement values to ascertain a type of distortion, if any, within the reflector and a type of distortion, if any, within the phased array feed; and determining compensation values for use in connection with said plurality of antenna elements for compensating for mechanical distortions within said ESR antenna system based on the types of distortion ascertained in said step of analyzing, said step of determining compensation values includes determining a set of compensation values for each of a plurality of antenna beam positions to be supported by said ESR antenna system and storing said compensation values in memory in association with corresponding antenna beam positions for later use in generating antenna beams in said antenna beam positions.

2. The method claimed in claim 1, wherein:

said step of analyzing includes ascertaining whether one or more of the following distortion types are present: reflector curvature, reflector ripple, reflector offset, reflector twist, feed curvature, feed ripple, feed offset, and feed tilt.

3. The method claimed in claim 1, wherein:

said step of determining compensation values includes determining said compensation values by mathematical manipulation of said plurality of displacement values.

4. The method claimed in claim 1, wherein:

said step of determining compensation values includes determining a phase compensation value for each of a subset of said plurality of antenna elements corresponding to a first beam position when at least one of the following distortion types are present: reflector curvature distortion, reflector ripple distortion, reflector offset distortion, feed curvature distortion, feed ripple distortion, and feed offset distortion.

5. The method claimed in claim 4, wherein:

said step of determining a phase compensation value includes determining, for a first antenna element associated with said first beam position, an error distance between a point where the reflector is and a point where the reflector should be along a line that intersects said first antenna element and is in a direction related to a direction of said first beam position when at least one of the following distortion types are present: reflector curvature distortion, reflector ripple distortion, and reflector offset distortion.

6. The method claimed in claim 5, wherein:

said step of determining a phase compensation value includes doubling said error distance.

7. The method claimed in claim 1, wherein:

said plurality of antenna elements are arranged in columns and rows.

8. The method claimed in claim 7, wherein:

said step of determining compensation values includes determining, when reflector twist distortion or feed tilt distortion is present, whether a different row of antenna elements should be used to generate a first beam position than a row previously designated to generate said first beam position.

9. The method claimed in claim 7, wherein:

said step of determining compensation values includes determining a plurality of amplitude weighting coefficients for use by a row of elements associated with a first beam position when reflector twist or feed tilt is present.

10. A method for calibrating an electronically scanned reflector (ESR) antenna including a reflector and a phased array feed having a plurality of antenna elements, comprising the steps of:

measuring a mechanical displacement associated with each of a plurality of points on said reflector and each of a plurality of points on said phased array feed, said measuring step resulting in a plurality of displacement values;

for a first beam position of the ESR antenna, determining a phase compensation value for each antenna element within a subset of said plurality of antenna elements associated with said first beam position using said plurality of displacement values; and storing said phase compensation values in a memory for later use in generating an antenna beam in said first beam position.

11. The method claimed in claim 10, further comprising:

repeating said steps of determining and storing for a second beam position of the ESR antenna.

12. The method claimed in claim 10, further comprising:

repeating said steps of determining and storing for each of the beam positions supported by the ESR antenna.

13. The method claimed in claim 10, wherein:

said plurality of antenna elements are arranged in columns and rows, wherein said subset of said plurality of antenna elements associated with said first beam position includes a first row of antenna elements.

14. The method claimed in claim 10, wherein:

said step of determining a phase compensation value includes calculating, for a first antenna element within said subset, an error distance between a point where said reflector is and a point where said reflector should be along a direction associated with said first beam position.

15. The method claimed in claim 14, wherein:

said step of determining a phase compensation value includes determining an electrical length of double said error distance.

16. The method claimed in claim 10, wherein:

said step of determining a phase compensation value includes calculating, for a first antenna element within said subset, an error distance between a point where said feed array is and a point where said feed array should be along a direction associated with said first beam position.

17. The method claimed in claim 16, wherein:

said step of determining a phase compensation value includes calculating an electrical length of said error distance.

18. The method claimed in claim 10, wherein:

said step of determining a phase compensation value includes calculating a first error distance associated with said reflector and a second error distance associated with said feed array and combining said first and second error distance into a single distance value.

19. The method claimed in claim 18, wherein:

said step of combining includes calculating a sum of said second error distance and twice said first error distance.

20. The method claimed in claim 10, further comprising:

for said first beam position of said ESR antenna, determining whether a different row of said plurality of antenna elements should be used to generate an antenna beam in said first beam position than a row originally designated to generate an antenna beam in said first beam position when reflector twist distortion or feed tilt distortion is present.

21. A self-calibrating electronically scanned reflector (ESR) antenna system, comprising:

a reflector having a feed array located approximately at a focal point thereof for generating an antenna beam in any of a plurality of predetermined beam positions;

means for determining displacement values for a plurality of points on said reflector and a plurality of points on said feed array, said displacement values indicating a displacement between an actual location of said points and a desired location of said points;

means for ascertaining mechanical distortion types present within said reflector and said feed array, if any, based on said displacement values;

means for generating compensation values for said ESR antenna system based on said distortion types identified by said means for ascertaining; and a memory that stores said compensation values for each of said plurality of predetermined beam positions being supported by said ESR antenna system, said compensation values being used in generating antenna beams in said predetermined beam positions.

22. The antenna system claimed in claim 21, wherein:

said means for determining displacement values includes a plurality of target scatterers distributed upon said reflector and a plurality of probes distributed upon said feed array.

23. The antenna system claimed in claim 22, wherein:

said plurality of probes includes a plurality of radio frequency (RF) probes and said means for determining displacement values includes means for performing a plurality of RF phase measurements using said plurality of target scatterers and said plurality of RF probes.

24. The antenna system claimed in claim 22, wherein:

said plurality of targets scatterers includes a plurality of mirrors, said plurality of probes includes a plurality of optical sensors, and said means for determining displacement values includes means for performing a plurality of optical angle measurements using a light source, said plurality of mirrors, and said plurality of optical sensors.

25. The antenna system claimed in claim 21, wherein:

said means for determining displacement values includes a plurality of temperature sensors distributed upon said reflector and a plurality of temperature sensors distributed upon said feed array.

26. The antenna system claimed in claim 21, wherein:

said means for determining displacement values includes means for performing optical path length measurements.

27. The antenna system claimed in claim 21, wherein:

said means for ascertaining mechanical distortion types includes means for identifying at least one of the following distortion types: reflector curvature distortion, reflector ripple distortion, reflector offset distortion, reflector twist distortion, feed curvature distortion, feed ripple distortion, feed offset distortion, and feed tilt distortion.

28. The antenna system claimed in claim 21, wherein:

said means for generating compensation values includes means for generating a compensation value set for each of said plurality of predetermined beam positions.

29. The antenna system claimed in claim 21, wherein:

said means for generating compensation values includes means for generating phase compensation values for antenna elements within said feed array when any of the following distortion types are present: reflector curvature distortion, reflector ripple distortion, reflector offset distortion, feed curvature distortion, feed ripple distortion, and feed offset distortion.

30. The antenna system claimed in claim 21, wherein:

said feed array includes a plurality of antenna elements, said plurality of antenna elements including a first group of elements for use in generating an antenna beam within a first subgroup of beam positions and a second group of elements for use in generating an antenna beam within a second subgroup of beam positions, wherein said means for generating compensation values includes means for determining whether to change the group of elements associated with a particular beam position when reflector twist or feed tilt is present.

* * * * *